United States Patent [19]

De Leon

[11] 4,220,839

[45] Sep. 2, 1980

[54] INDUCTION HEATING COIL FOR FLOAT ZONE MELTING OF SEMICONDUCTOR RODS

[75] Inventor: Noel De Leon, Frederikssund, Denmark

[73] Assignee: Topsil A/S, Denmark

[21] Appl. No.: 867,202

[22] Filed: Jan. 5, 1978

[51] Int. Cl.[3] ..... H05B 5/00

[52] U.S. Cl. ..... 219/10.49 R; 219/10.43; 219/10.79; 156/620; 156/605

[58] Field of Search ..... 219/10.49, 10.43, 10.79; 156/605, 620; 23/273 SP

[56] References Cited

U.S. PATENT DOCUMENTS

| | | | |
|---|---|---|---|
| 891,657 | 6/1908 | Berry | 219/10.49 |
| 1,981,632 | 11/1934 | Northrup | 219/10.51 |
| 3,827,017 | 7/1974 | Keller | 219/10.43 |
| 4,109,128 | 8/1978 | Kohl | 156/605 |

*Primary Examiner*—Elliot A. Goldberg
*Assistant Examiner*—Philip H. Leung
*Attorney, Agent, or Firm*—John A. Fisher

[57] ABSTRACT

An induction heating coil for the float zone melting of semiconductor materials. The distribution of current on the surfaces of the coil is modified by altering the surfaces of the coil. The alteration of the surfaces is in the form of selectively positioned saw slots and solid conductor strips. The current distribution can be controlled independently on the top and bottom surfaces of the coil.

14 Claims, 5 Drawing Figures

FIG. 1 (PRIOR ART)
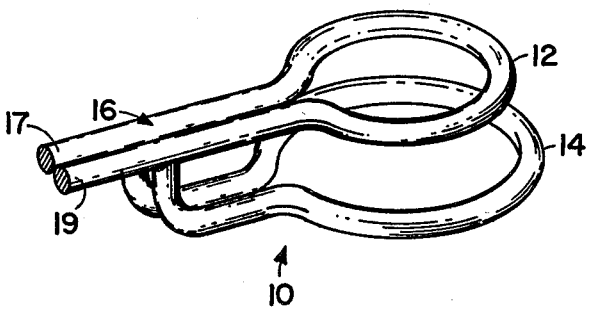
FIG. 2
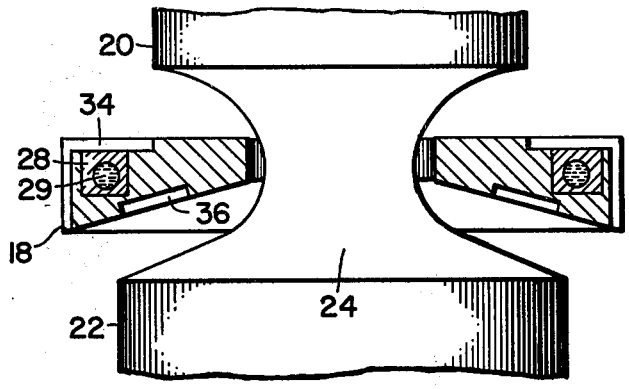
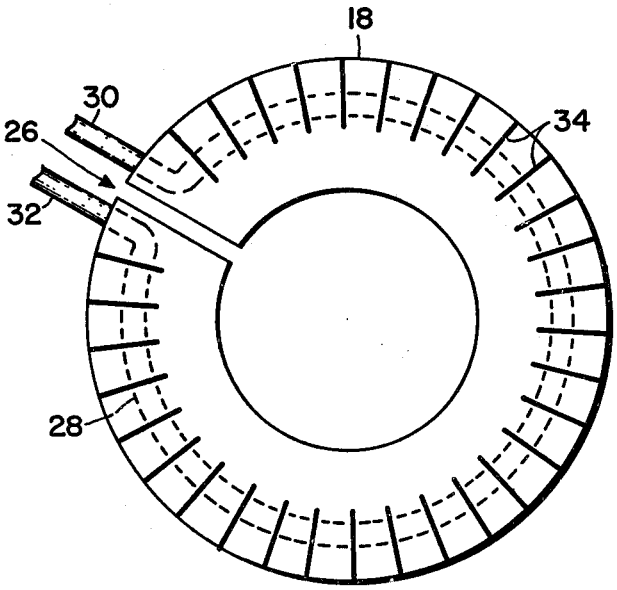
FIG. 3

INDUCTION HEATING COIL FOR FLOAT ZONE MELTING OF SEMICONDUCTOR RODS

BACKGROUND OF THE INVENTION

This invention relates to an induction heating coil for the crucible free melting of crystalline material and more particularly to an induction heating coil that is suitable for the float zone melting of large, high quality crystals of semiconductor material.

Float zone melting is used to convert polycrystalline material to high quality monocrystalline rod, to remove unwanted impurities from the material, and simultaneously to distribute dopant atoms uniformly throughout the crystal. In the float zone process a narrow molten zone is caused to move slowly along the length of a vertically disposed rod of the crystalline material. As the molten zone moves, the material immediately behind the zone can be made to resolidify as monocrystalline material. The monocrystalline growth is initially nucleated by a single crystal seed and then continues in a self-seeding manner. Also, as the molten zone moves, it sweeps impurities with it and distributes dopant atoms, leaving the material behind the zone in a more pure and uniformly doped state.

The molten zone is caused to traverse the length of the polycrystalline rod by moving the rod vertically past a stationary heating means such as an RF induction coil surrounding the material. This molten zone is unsupported, being held in position only by surface tension and electromagnetic forces. Because the zone has no support means such as contact with the walls of a crucible, the size and shape of the zone are extremely critical. If the zone becomes too large, the electromagnetic and surface tension forces will be unable to confine the large amount of molten material and the molten material will spill under the influence of gravity. Conversely, if the molten zone is of too limited extent, the central portion of the material may not be completely melted, resulting in poor crystal quality. The critical shaping of the molten zone is controlled by the distribution of current induced in the rod, and this, in turn, is controlled primarily by the shape and design of the induction coil used to form that zone. A wide variety of coils have been tried, including both single turn and multiple turn coils. The latter may have the multiple turns in parallel or it may be helical shaped. The coils may be formed of cylindrical tubing or may be milled in a "pancake" shape. All of the various geometries are designed to distribute the current in such a way as to provide the necessary heating to the total cross section of the rod and to stabilize the melt. These various coil designs have not proved to be totally satisfactory, especially with large diameter crystals. For example, a commonly used coil is made of two parallel turns of tubing. One of the turns is smaller than and positioned above the other. This configuration of concentric coils helps to support and stabilize the melt, and ensures that the entire cross section of the material is molten. Coils formed from cylindrical tubing, however, are difficult to shape precisely, and can easily be bent out of the desired shape, especially when the coil is new and the coil material is soft. Additionally, the current must, of course, be confined to the turns of the coil and thus the current is distributed in discrete steps. The current, therefore, can not be smoothly varying from top to bottom of the molten zone.

Flat pancake style coils can be milled from a piece of solid stock, and can therefore be produced to tight dimensional tolerances. Such coils are also more substantial and rugged than the coiled tubing type and thus are less susceptible to accidental deformation. But the pancake coils have less flexibility of design because the currents are carried equally by all surfaces of the coil.

Accordingly, a need existed for an improved radio frequency induction coil for the float zone melting of crystalline materials which would overcome the problems inherent in the prior art coils.

BRIEF SUMMARY OF THE INVENTION

It is a primary aim of this invention to provide a radio frequency induction coil that can be easily and reproducibly fabricated. The current distribution through the RF coil can be adjusted to alter the resultant induced current and thus the temperature distribution in the rod of material to be refined. The adjustments in the current distribution in the coil can be made independently on the top and bottom surfaces of the coil.

The float zone induction coil in accordance with the invention is milled from a solid piece of conductor material in the shape of a flat "pancake" coil. A shallow groove is milled in the coil to accept a piece of tubing which is welded or soldered into the groove to provide water cooling for the coil. The current distribution through the coil is then determined by sawing slots in the surface of the coil. The saw slots serve to steer the current, confining the current to those areas of the coil which do not have saw slots. The current distribution on the top and bottom surfaces of the coil can be determined independently by the particular array of saw slots on each surface. Once a given array of saw slots has been established, it can be changed or further altered by milling a groove in the surface of the coil and inserting a solid piece of conductor in the groove. The solid piece can replace, and thus cancels out, the effect of the saw slots. Alternatively, a solid piece of conductor can be welded or otherwise affixed to the surface of the coil to either cancel the effect of the underlying saw slots or to enhance the current carrying capability of that particular localized portion of the coil.

The objects of the invention and the benefits to be derived therefrom should be more readily apparent after review of the following more detailed description of the invention taken in connection with the drawings.

DESCRIPTION OF THE FIGURES

FIG. 1 is a perspective view of one type of prior art induction heating coil.

FIG. 2 is a side view of an induction heating coil in accordance with the invention.

FIGS. 3 and 4 are top and bottom views of the induction heating coil.

DETAILED DESCRIPTION OF THE INVENTION

Figure 4:
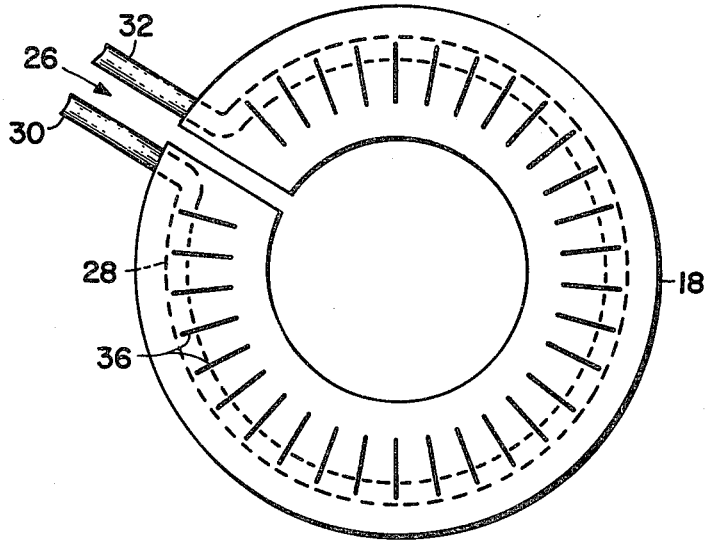

FIG. 1 shows one of the typical prior art coils 10. It consists of two concentric coils, a smaller top coil 12 and a larger bottom coil 14. The coils 12, 14 could be formed from copper tubing or other suitable conductor material. The two coils are joined together at junction 16 so that the two coils are electrically in parallel. The common ends 17, 19 of the coil are connected both to a source of radio frequency power and to a water cooling system. Water flows through the hollow tubing of the coils to keep the coils cool, since they will be in close proximity to the molten crystalline material. The two coils ensure that sufficient energy is coupled to the crystalline material to melt the entire cross section of the material. The smaller coil 12 inductively couples with the central portion of the melt while the larger coil 14 couples to the outer portion of the melt to establish a reasonably shaped freezing interface. The two coils 12, 14 act together to stabilize the melt; with only a single turn, the growing crystal tends to spiral off in an uncontrolled direction.

Turning now to FIG. 2, there is shown in cross section a radio frequency (RF) induction coil 18 in accordance with the invention. Coil 18 is shown together with a silicon rod being float zone refined. The preferred embodiment is herein described for the float zone refining of a silicon rod of a particular size. A polycrystalline feed stock rod 20 about 50–80 millimeters in diameter is converted by the crucible free refining process to a single crystal rod 22 that is about 75–110 millimeters in diameter. It will be appreciated that this is just a single particular example to illustrate the invention. Those skilled in the art will understand that appropriate modifications can be made within the spirit of the invention for the zone refining of other materials and other sizes. The molten zone 24 of the silicon material necks down to a smaller diameter to pass through the center of the coil 18. The molten zone is heated by currents induced in the rod by the induction coil. The coil can be, for example, about 10–15 millimeters in thickness at its outer edge and taper to a few tenths of a millimeter thickness at the center.

FIG. 3 shows a top view of the induction coil 18. The coil 18 can be machined from copper, silver, or other conductive material stock. The outer diameter of coil 18 can be, for example, about 90–140 millimeters and the inner diameter can be about 20–35 millimeters, with the opening being circular, oval, or otherwise shaped. A gap 26 is cut in the toroid shaped coil 18 so that the coil forms a single turn substantially surrounding the crystalline material. To provide cooling for the coil, a slot 28 shown by the dotted lines, is milled in the surface of the coil. Into this slot is pressed a piece of tubing 29 having ends 30 and 32. The tubing can be, for example, 5 millimeter diameter copper tubing. The tubing is silver soldered or welded into the slot 28 and the surface of the coil 18 is ground smooth. In use, the ends 30, 32 of the copper tubing are connected to a source of flowing water and also to an RF power source, neither of which is shown. The water cooling is required to keep the coil 18 from melting as the result of the high currents on the coil surface.

Current flows in the coil 18 from the RF power generator. The current distribution in the coil can be controlled by selectively sawing a number of slots 34 in the surface of the coil. By controlling the current distribution, it is possible to control the electrical field pattern and thus the distribution of the current induced in the silicon rod. At the radio frequency of interest in float zone melting (about 2–5 MHz) the skin depth in copper is less than 0.05 millimeter and thus substantially all of the current flows on the surface of the coil. Thus a saw slot 34 of about 1 millimeter width and 1–2 millimeters depth is effective in locally increasing the electrical impedance. It has been determined that about 20–50 radially directed saw slots 34 on the upper surface of the coil are effective in properly controlling the current distribution. These can be uniformly spaced about the circumference of the coil or can be asymmetrically arranged to provide a particular distribution. To heat the central portion of the feed stock rod 20, and to help stabilize the melt, the saw slots 34 on the top surface of the coil 18 can be located towards the outer periphery of the coil and can extend over the edge of the coil, with the inner part of the coil free from saw slots. This arrangement of slots 34 forces the current to the center of the coil and leaves the outer portion of the coil relatively current free. The saw slots 34 can extend, for example, from about 80 millimeters from the center of the coil to the outside edge of the coil.

The bottom of the induction coil 18 is shown in FIG. 4. The current distribution on this surface of the coil is established, in a manner similar to the top surface, by sawing slots 36 in the surface of the coil 18. The saw slots 36 on the bottom surface of the coil need not be identical to the saw slots 34 on the top surface of the coil. Thus the current distributions on the top and bottom of the coil can be adjusted independently. For the particular example described, it has been found expedient to saw 30–40 evenly spaced, radial slots extending from about 20 millimeters from the center of the coil to about 40 millimeters from the center. The current is thus confined to the inner and outer portions of the bottom of the coil 18 and is excluded or reduced in the central portion.

Figure 5:
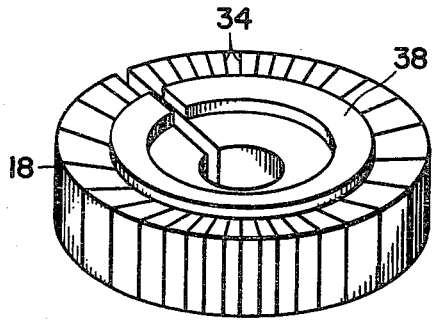
FIG. 5 is a perspective view of a further embodiment of the invention.

FIG. 5 again shows a float zone induction coil 18 having a saw slots 34 in the top surface for establishing a particular current distribution. In addition to the saw slots, however, an additional technique is employed for changing the current distribution. The saw slots are used to increase the surface impedance in certain regions of the coil; in the alternate technique the impedance is lowered by welding solid conductor strips 38 to the surface of the coil to locally increase the current density. A slot can be milled in the surface of the coil and a solid strip 38 of copper or other conductor material welded into that slot. The strip 38 can be flush with the coil surface, can protrude, or can be recessed in the surface depending on the desired effect. The use of the strips 38 can be useful when experimentally determining the correct placement of the saw slots 34. If it is determined, for example, that the saw slots extend too far along a radius, the undesired end of the saw slot can be milled out and a strip 38 inserted to restore the coil surface to essentially the unsawed state. Most importantly, however, the strips 38 provide an additional degree of flexibility in establishing the desired current distribution. It has been found particularly desirable to insert a strip 38 on the upper surface of the coil 18 which is concentric with the coil, has an inner diameter of about 50–60 millimeters and an outer diameter of about 80–85 millimeters, and which extends about 2 millimeters above the original surface of the coil 18. Such a strip 38 allows much greater flexibility in the diameter of the feed stock rod 20 that can be accommodated in the zone melting process. The strip 38 has been shown in conjunction with saw slots 34 on the top surface of the coil. In other situations it might be desirable to use such strips on either or both surfaces. The strips might be used with saw slots or might be used alone.

Thus it is apparent that there has been provided, in accordance with the invention, a float zone induction heating coil that fully satisfies the aims and advantages set forth above. While the invention has been described in conjunction with a specific embodiment, it is evident that many alternatives and variations will be apparent to those skilled in the art in light of the foregoing description. These alternatives and variations will apply particularly when zone melting other crystalline materials, especially crystalline materials having different physical dimensions.

What is claimed is:

1. In a method for forming an induction heating coil oriented about an axis and having first and second major surfaces spaced apart in the direction of said axis for the float zone melting of crystalline material the improvement which comprises altering said major surfaces of said coil to change the current distribution on said major surfaces by providing a first set of slots into said first surface but not extending to a depth in the direction of said axis to intersect said second major surface and a second set of slots into said second major surface but not extending to a depth in the direction of said axis to intersect said first major surface.

2. The method of claim 1 wherein said altering of the surfaces of said coil further comprises the affixing of solid conductor pieces to the surfaces of said coil.

3. An induction heating coil of the flat pancake type for the float zone melting of semiconductor material which comprises:

a single, water-cooled turn of conductor material substantially surrounding said semiconductor material and having top, bottom, and side surfaces;

means for independently altering the distribution of current carried by said top, bottom, and side surfaces.

4. The induction heating coil of claim 3 wherein said means comprise a plurality of selectively positioned saw slots in said surfaces but not extending through the total thickness of said coil and metal conductor strips affixed to said surfaces.

5. The induction heating coil of claim 4 wherein said saw slots are radially directed.

6. The induction heating coil of claim 4 wherein said saw slots are positioned independently on said top, bottom, and side surfaces.

7. An induction heating coil for the crucible free melting of semiconductor materials comprising:

a single-turn pancake coil formed of copper, said coil having top and bottom surfaces;

radially directed saw slots positioned near the outer periphery of said top surface of said coil, said slots extending into said top surface but not through the total thickness of said coil;

radially directed saw slots positioned in the central portion of said bottom surface of said coil, said slots in said bottom surface positioned independently of said slots in said top surface; and a concentric strip of conductor material affixed to and protruding above said top surface of said coil.

8. The induction heating coil of claim 7 wherein said saw slots are about 1 millimeter in width and 2 millimeters in depth.

9. In an induction heating element including a single turn, flat coil, said coil having top, bottom, inside, and outside surfaces in which radio frequency current flows primarily by skin effect in a generally circular path, the improvement comprising:

a plurality of slots extending in a generally radial direction selectively and independently positioned in each of said top and bottom surfaces for changing the impedance of portions of said surfaces while retaining a generally circular current flow in said surfaces.

10. The induction heating element of claim 9 in which said slots exceed the skin depth of said radio frequency current and have lengths shorter than the radial width of said top and bottom surfaces, respectively.

11. The induction heating element of claim 10 in which the slots in said top surface intersect said outside surface for defining a low impedance path at the inner portion of said top surface.

12. The induction heating element of claim 11 in which the slots in said bottom surface intersect neither said inner nor said outer surface for defining low impedance paths at the inner and outer portions of said bottom surface.

13. The induction heating element of claim 9 further comprising slots in said outer surface.

14. The induction heating element of claim 13 wherein said slots in said outer surface intersect with said slots in said top surface.

* * * * *